United States Patent [19]

Hey

[11] 4,303,558

[45] Dec. 1, 1981

[54] CLEANING COMPOSITION COMPRISING 1,1,2-TRICHLORO-1,2,2-TRIFLUOROETHANE AND AN ALCOHOL

[75] Inventor: David G. Hey, Northwich, England

[73] Assignee: Imperial Chemical Industries Limited, London, England

[21] Appl. No.: 72,171

[22] Filed: Sep. 4, 1979

[30] Foreign Application Priority Data

Sep. 15, 1978 [GB] United Kingdom ..... 36980/78
Nov. 13, 1978 [GB] United Kingdom ..... 44220/78

[51] Int. Cl.[3] ..... C11D 7/52; C11D 3/44; C11D 3/32

[52] U.S. Cl. ..... 252/548; 252/153; 252/171; 252/172

[58] Field of Search ..... 252/153, 171, 548, 172

[56] References Cited

U.S. PATENT DOCUMENTS

| | | | |
|---|---|---|---|
| 2,969,329 | 1/1961 | Heininger | 252/153 |
| 2,999,816 | 9/1961 | Bennett et al. | 252/171 |
| 3,240,715 | 3/1966 | Foley | 252/548 |
| 3,337,471 | 8/1967 | Levy et al. | 252/153 |
| 3,340,199 | 9/1967 | Clay et al. | 252/171 |
| 3,503,891 | 3/1970 | Schimbor | 252/548 |

FOREIGN PATENT DOCUMENTS

| | | | |
|---|---|---|---|
| 1307274 | 2/1973 | United Kingdom | 252/171 |

*Primary Examiner*—P. E. Willis, Jr.
*Attorney, Agent, or Firm*—Cushman, Darby & Cushman

[57] ABSTRACT

An improved cleaning composition for removal of flux from printed circuit boards consists essentially of the azeotropic mixture of 1,1,2-trichloro-1,2,2-trifluoroethane and a lower aliphatic alcohol and containing as additive an N-substituted or N,N-disubstituted amide of an aliphatic carboxylic acid wherein there is at least one hydroxyalkyl or hydroxyalkenyl substituent of up to 8 carbon atoms attached to the amide nitrogen atom.

13 Claims, No Drawings

CLEANING COMPOSITION COMPRISING 1,1,2-TRICHLORO-1,2,2-TRIFLUOROETHANE AND AN ALCOHOL

This invention relates to a cleaning composition comprising 1,1,2-trichloro-1,2,2-trifluoroethane and an aliphatic alcohol.

It is well known that constant boiling mixtures otherwise known as azeotropic mixtures of 1,1,2-trichloro-1,2,2-trifluoroethane and the lower aliphatic alcohols for example, methanol, ethanol and isopropyl alcohol are useful for a variety of cleaning purposes. They may be used for example in the cleaning of printed circuit boards to remove flux. However such mixtures are not entirely satisfactory for the cleaning purpose since often they do not remove all the flux, especially the more modern fluxes which are very difficult to remove.

It is an object of the present invention to provide an improved cleaning composition approximating to the azeotropic mixtures of 1,1,2-trichloro-1,2,2-trifluoroethane and lower aliphatic alcohols having up to three carbon atoms but which also contain a special additive whereby improved cleaning effects can be obtained.

According to the present invention therefore we provide a cleaning composition comprising the approximate azeotropic mixture of 1,1,2-trichloro-1,2,2-trifluoroethane and a lower aliphatic alcohol and containing as additive an N-substituted or N,N-disubstituted amide of an aliphatic carboxylic acid wherein there is at least one hydroxyalkyl or hydroxyalkenyl substituent of up to 8 carbon atoms attached to the amide nitrogen atom.

The phase "approximate azeotropic mixture" means those mixtures which boil within ±2° C. of the azeotropic mixture. Preferably the mixture boils within ±1° C. of the azeotropic mixture. More preferably the azeotropic mixture itself is employed.

Preferably the lower aliphatic alcohol has one to three carbon atoms. More preferably the aliphatic alcohol is methyl alcohol or ethyl alcohol. The alcohol may be pure or contain small amounts of impurities. For example a commercially available source of ethyl alcohol known as industrial spirit containing about 4% by weight methanol may be used.

Preferably the N-substituted or N,N-substituted amide is of formula R—CO—NXY where X is a hydroxyalkyl group having 1 to 8 carbon atoms or hydroxyalkenyl group having 2 to 8 carbon atoms, Y is a hydroxyalkyl group having 1 to 8 carbon atoms or hydroxyalkenyl group having 2 to 8 carbon atoms, hydrogen, an alkyl group having 1 to 8 carbon atoms or an alkylene group having 2 to 8 carbon atoms, and R is an alkyl group having 1 to 23 carbon atoms or an alkylene group having 2 to 23 carbon atoms.

The alkyl chain of the hydroxyalkyl group and the alkylene chain of the hydroxyalkenyl group preferably contains 1 to 5 carbon atoms and 2 to 5 carbon atoms, respectively. The hydroxyl substituent(s) may be attached to any one of the carbon atoms in the alkyl or alkylene chain but is (are) preferably attached to a terminal carbon atom. When X and Y is a hydroxyalkyl group or hydroxyalkenyl group X and Y may be the same or different.

Suitably X is a hydroxyalkyl group, for example a 2-hydroxyethyl group. When Y is a hydroxyalkyl group it is usually the same as X, suitably a 2-hydroxyethyl group.

The group R of the additive preferably contains 6 to 17 carbon atoms and may be for example the lauryl group (containing 11 carbon atoms).

Mixtures of the additives may be used, if desired. In particular a mixture of additives may comprise N-substituted or N,N-disubstituted derivatives of amides having a range of carbon atoms in the group R. Thus, for example, the main component of the mixture of N,N-disubstituted amides may be one wherein the group R contains 11 carbon atoms for example, N,N-di(2-hydroxyethyl)lauramide, $C_{11}H_{25}$—CO—N($CH_2CH_2OH$)$_2$, and there may also be present derivatives in which group R contains from 6 to 17 carbon atoms.

The additives in the present cleaning composition preferably boil at temperatures above 200° C. and are involatile under the cleaning conditions of use.

Quite small amounts of the additive are required to obtain the improved cleaning effect in the present cleaning compositions. Usually there is employed at least 0.01% by weight of additive in making up the cleaning composition, for example 0.01% to 2% by weight with reference to the total cleaning composition. Greater proportion by weight of the additive, for example up to 3% by weight may be used but there is no advantage in using such a high proportion as 3% or higher since no further advantage is gained and high proportions of additives necessarily lead to higher cost.

The present compositions are efficient cleaning agents. However they are capable of improvement in respect of stability when the compositions are used in contact with metals, for example, a metal such as copper or alloys thereof containing a high proportion of copper. This may happen for example when the cleaning composition contacts pipe work made of copper and indeed when it contacts the articles to be cleaned which have copper members attached thereto. Under such conditions, slight discolouration of the solvent composition may occur and solid material other than removed contaminant may be found in the solvent. This is not desirable in the cleaning procedure.

It is a further object of the present invention to provide a solvent cleaning composition of improved stability in the presence of metals such as copper.

According to a further feature of the invention therefore there is provided the hereinbefore described cleaning composition comprising the approximate azeotropic mixture of 1,1,2-trichloro-1,2,2-trifluoroethane and a lower aliphatic alcohol and the N-substituted or N,N-disubstituted amide together with a benzotriazole or a benzimidizole.

By the terms "a benzotriazole" or "a benzimidazole" as used throughout this specification there are meant compounds having the generic formulae

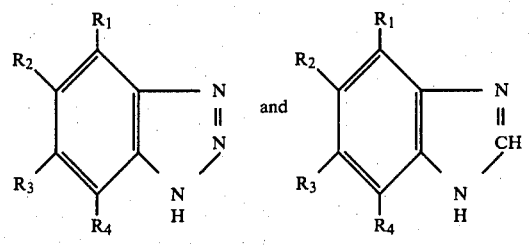

respectively, where $R_1$, $R_2$ $R_3$ and $R_4$ may be hydrogen or an alkyl radical having 1 to 6 carbon atoms. It is preferred to use the non-alkyl substituted materials, that is, benzotriazole and benzimidazole. Of these it is preferred to use benzotriazole.

The amount of the benzotriazole or benzimidazole in the present cleaning compositions required to overcome any disadvantages referred to hereinbefore need only be quite small. Usually there is present 0.005% w/w to 1% w/w of a benzotriazole or a benzimidazole with reference to the cleaning composition. In such proportions the benzotriazole and benzimidazole are soluble in the azeotropic mixture of the trichlorotrifluoroethane and alcohol.

The compositions may if desired contain small amounts of other adjuvants; for example small amounts of conventional stabilisers for the mixture of 1,1,2-trichloro-1,2,2-trifluoroethane and alcohol, for instance a small amount of a mononitroalkane.

The compositions of the present invention may be used in conventional operating techniques. Preferably the composition is employed at the boil.

The contaminated article may be immersed in the cleaning composition or jetted with a spray of the liquid composition. Suitably also the article after treatment with the cleaning composition is rinsed with a composition containing the trichlorotrifluoroethane and alcohol, suitably the azeotropic composition, if desired, also initially containing the additives. The compositions are useful in a variety of cleaning processes, for example, in the removal of flux and other contaminants. They are also useful in the removal of water from contaminated articles.

The present invention includes within its scope a process of incorporating and substituted amide and, if desired, the benzotriazole or benzimidazole into the aforesaid mixtures of 1,1,2-trichloro-1,2,2-trifluoroethane and aliphatic alcohols.

The present invention also includes within its scope a method of cleaning articles by bringing them into contact with a cleaning composition as described hereinbefore.

The following Examples illustrate the invention. Where percentages are mentioned they are by weight.

EXAMPLE 1

A conventional, stainless steel degreasing unit was employed having a cleaning compartment and a rinsing compartment and a condenser running round the upper portion of the walls of the unit. The cleaning and rinsing compartments were both 25 cms long by 15 cms wide. Into the cleaning compartment there was placed to a depth of 10 cms a cleaning composition comprising the azeotropic mixture of 1,1,2-trichloro-1,2,2-trifluoroethane (95.5%) and (industrial) ethyl alcohol (4.5%) and 0.1% of an additive. This additive was a coconut fatty acid diethanolamide boiling above 200° C. whereof the R component in the hereinbefore described formula was an alkyl group predominating in a lauryl group and also containing 6 to 17 carbon atoms which is available commercially from Lankro Chemicals Ltd., England under the Trade Mark 'Ethylan' A15. Into the rinsing compartment an amount of the same cleaning composition also initially containing the additive was placed to a depth of 20 cms. The composition in both compartments was heated to boiling, the vapours were condensed and the condensate fed to the rinsing compartment. There was an overflow of cleaning composition from rinsing to cleaning compartment so that additive was removed from and passed to the cleaning compartment.

Printed circuit boards (size 5 cms by 2.5 cms) having a substrate of epoxy resin glass mat laminate and contaminated with a flux shown as 'Zeva' C40 ('Zeva' is a Trade Mark) were dipped for periods of from ½ minute to 1 minute both in the cleaning tank and in the rinsing tank. Printed boards which had also been coated with a flux known as Fry's R8 were similarly treated.

The treated boards were all found to be perfectly clean.

Boards contaminated with said flux were treated with said cleaning compositions which however contained 0.3% of said coconut fatty acid diethanolamide and 0.05% nitromethane. The treated boards were again found to be perfectly clean.

COMPARISON

By way of comparison the above procedure was repeated with said azeotropic mixture not containing the additive. After treatment the boards still showed presence of small amounts of flux and white powder.

EXAMPLE 2

The procedure of Example 1 was repeated except that the cleaning composition was an azeotropic mixture of 1,1,2-trichloro-1,2,2-trifluoroethane (93.6%) and methyl alcohol (6.4%) together with the additive.

The treated boards were again found to be perfectly clean.

COMPARISON

By way of comparison the procedure of Example 2 was repeated with said azeotropic mixture not containing the additive. After treatment the boards showed presence of small amounts of flux and white powder.

EXAMPLE 3

A conventional stainless steel degreasing unit was employed having a cleaning compartment and a rinsing compartment and a condenser consisting of copper pipework running around the upper portions of the walls of the unit. The cleaning and rinsing compartments were both 25 cms long by 15 cms wide, and contained drainage connections fitted to facilitate cleaning out of the plant after use. These connections were fabricated of copper. Into the cleaning compartment was placed to a depth of 10 cm a cleaning composition comprising the azeotropic mixture of 1,1,2-trichloro-1,2,2-trifluoroethane (95.4%) and ethyl alcohol (4.5%), 0.1% of a substituted amide additive and 0.02% of benzotriazole. The substituted amide additive was a coconut fatty acid diethanolamide boiling above 200° C. as described in Example 1.

Into the rinsing compartment an amount of the same cleaning composition also initially containing the substituted amide derivative and benzotriazole was placed to a depth of 20 cms. The composition in both compartments was heated to boiling, the vapours were condensed and the condensate fed to the rinsing compartment. There was an overflow of cleaning composition from rinsing to cleaning compartment so that additive and benzotriazole was removed from the rinsing compartment and passed to the cleaning compartment.

Printed circuit boards (size 5 cms by 2.5 cms) having a substrate of epoxy resin glass mat laminate and contaminated with a flux known as 'Zeva' C40 ('Zeva' is a Registered Trade Mark) were dipped for periods of from ½ minute to 1 minute both in the cleaning compartment and then in the rinsing compartment. Printed boards which had also been coated with a flux known as Fry's R8 were similarly treated.

The degreasing unit was operated for a period of 230 hours. After that time there was still no discolouration of the solvent composition and there was no evidence of solid in the composition (other than contaminant removed). The treated boards were found to be perfectly clean.

COMPARISON

By way of comparison the procedure of Example 3 was repeated with a similar solvent composition which did not however contain a benzotriazole. After 30 hours the treated boards were still found to be clean but there was slight discolouration of the solvent composition and evidence of solid in the composition other than removed contaminant.

What is claimed is:

1. A cleaning composition comprising the approximate azeotropic mixture of 1,1,2-trichloro-1,2,2-trifluoroethane and a lower aliphatic alcohol and containing a cleaning-improving amount of an N-substituted or N,N-disubstituted amide of an aliphatic carboxylic acid wherein there is at least one hydroxyalkyl or hydroxyalkenyl substituent of up to 8 carbon atoms attached to the amide nitrogen atom.

2. A composition as claimed in claim 1 in which the N-substituted or N,N-disubstituted amide is of formula R—CO—NXY where X is a hydroxyalkyl group having 1 to 8 carbon atoms or hydroxyalkenyl group having 2 to 8 carbon atoms, Y is a hydroxyalkyl group having 1 to 8 carbon atoms or a hydroxyalkenyl group having 2 to 8 carbon atoms, hydrogen, an alkyl group having 1 to 8 carbon atoms or an alkylene group having 2 to 8 carbon atoms and R is an alkyl group having 1 to 23 carbon atoms or an alkylene group having 2 to 23 carbon atoms.

3. A composition as claimed in claim 1 or claim 2 in which the alkyl chain of the hydroxyalkyl group and the alkylene chain of the hydroxyalkenyl group in the substituted amide contains 1 to 5 carbon atoms and 2 to 5 carbon atoms, respectively.

4. A composition as claimed in claim 1 or claim 2 in which a hydroxy substituent is attached to a terminal carbon atom of the alkyl or alkylene chain of the hydroxyalkyl or hydroxyalkenyl group of the substituted amide.

5. A composition as claimed in claim 1 or claim 2 in which X and/or Y is a hydroxyalkyl group.

6. A composition as claimed in claim 1 or claim 2 in which the hydroxyalkyl group is a 2-hydroxyethyl group.

7. A composition as claimed in claim 1 or claim 2 in which the group R of the substituted amide contains 6 to 17 carbon atoms.

8. A composition as claimed in claim 1 or claim 2 in which there is employed a mixture of N,N-disubstituted amides the main component of which is one wherein the group R contains 11 carbon atoms.

9. A composition as claimed in claim 8 wherein the main component is N,N-di-(2-hydroxyalkyl)lauramide and wherein there may also be present amides in which the group R contains from 6 to 18 carbon atoms.

10. A composition as claimed in claim 1 or claim 2 wherein the additive boils at a temperature above 200° C.

11. A composition as claimed in claim 1 or claim 2 in which the additive is present in proportions of 0.01% to 3% by weight with reference to the total cleaning composition.

12. A composition as claimed in claim 1 or claim 2 which also contains a benzotriazole or a benzimidazole.

13. A method of cleaning articles by bringing them into contact with a cleaning composition as described in claim 1 or claim 2.

* * * * *